US009689303B2

(12) United States Patent
Harada et al.

(10) Patent No.: US 9,689,303 B2
(45) Date of Patent: Jun. 27, 2017

(54) CYLINDER HEAD HAVING EGR GAS COOLING STRUCTURE, AND METHOD FOR MANUFACTURING SAME

(75) Inventors: Takahiro Harada, Chiryu (JP); Masahiko Asano, Toyota (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 13/698,091

(22) PCT Filed: May 17, 2010

(86) PCT No.: PCT/JP2010/058280

§ 371 (c)(1),
(2), (4) Date: Nov. 15, 2012

(87) PCT Pub. No.: WO2011/145163

PCT Pub. Date: Nov. 24, 2011

(65) Prior Publication Data

US 2013/0055970 A1 Mar. 7, 2013

(51) Int. Cl.
*F02F 1/14* (2006.01)
*F01P 3/20* (2006.01)
(Continued)

(52) U.S. Cl.
CPC ..... *F01P 3/20* (2013.01); *F02M 26/30* (2016.02); *F02M 26/32* (2016.02); *F02M 26/41* (2016.02);
(Continued)

(58) Field of Classification Search
USPC ..... 123/41.79, 193.5, 568.13; 29/888.06; 165/178
See application file for complete search history.

(56) References Cited

U.S. PATENT DOCUMENTS 5,333,581 A * 8/1994 Cagle ..... 123/193.5
5,511,612 A * 4/1996 Tajima ..... F28D 9/0012 165/167
(Continued)

FOREIGN PATENT DOCUMENTS

EP 930429 A2 * 7/1999
JP H06-76644 U 10/1994
(Continued)

OTHER PUBLICATIONS

Machine Translation of JP 08049606 A PDF File Name: "JP08049606A_Machine_Translation.pdf".*
(Continued)

*Primary Examiner* — Hung Q Nguyen
*Assistant Examiner* — Ruben Picon-Feliciano
(74) *Attorney, Agent, or Firm* — Andrews Kurth Kenyon LLP

(57) ABSTRACT

It has been difficult to manufacturing a cylinder head having an EGR gas cooling structure which has high cooling performance and can be easily configured. A cylinder head having an EGR gas cooling structure is configured in such a manner that a gas passage which guides to the air intake port side a part of the exhaust gas discharged from the exhaust port is disposed within the cylinder head water jacket to cool the exhaust gas flowing through the gas passage. The gas passage comprises a cooling section which makes contact with the coolant within the cylinder head water jacket, and also comprises a hollow pipe which has high-strength sections located at side portions of the cooling section and having higher strength than the cooling section. The high-strength sections of the gas passage are molded within and surrounded by the cylinder head.

14 Claims, 8 Drawing Sheets

(51) Int. Cl.

| | |
|---|---|
| ***F02M 26/30*** | (2016.01) |
| ***F02M 26/32*** | (2016.01) |
| ***F02M 26/41*** | (2016.01) |
| *F01P 3/02* | (2006.01) |

(52) U.S. Cl.
CPC ..... *F01P 3/02* (2013.01); *F01P 2003/024* (2013.01); *F01P 2060/16* (2013.01); *Y10T 29/4927* (2015.01)

(56) References Cited

U.S. PATENT DOCUMENTS

| | | | | |
|---|---|---|---|---|
| 5,918,667 | A * | 7/1999 | Chiba | F28D 1/05341 165/173 |
| 6,478,017 | B2 * | 11/2002 | Bianchi | 123/568.12 |
| 6,971,378 | B2 * | 12/2005 | Mackey et al. | 123/568.13 |
| 7,055,586 | B2 * | 6/2006 | Sakakibara et al. | 165/158 |
| 2002/0043254 | A1 * | 4/2002 | Iizuka et al. | 123/568.13 |
| 2004/0134640 | A1 | 7/2004 | Sakakibara et al. | |

FOREIGN PATENT DOCUMENTS

| | | | | |
|---|---|---|---|---|
| JP | 08-049606 | A | | 2/1996 |
| JP | 08049606 | A | * | 2/1996 |
| JP | 8319902 | A | | 12/1996 |
| JP | 10002256 | A | * | 1/1998 |
| JP | 2002004953 | A | | 1/2002 |
| JP | 2002350081 | A | | 12/2002 |
| JP | 2005320980 | A | | 11/2005 |
| JP | 2007224784 | A | * | 9/2007 |
| JP | 2009270513 | A | | 11/2009 |
| JP | 2010025034 | A | | 2/2010 |

OTHER PUBLICATIONS

Machine Translation of JP 10002256 A PDF File Name: "JP10002256A_Machine_Translation.pdf".*
Machine Translation of EP 930429 A2 PDF File Name: "EP930429A2_Machine_Translation.pdf".*
Machine Translation of JP2007224784A PDF File Name: "JP2007224784A_Machine_Translation.pdf".*

* cited by examiner

CYLINDER HEAD HAVING EGR GAS COOLING STRUCTURE, AND METHOD FOR MANUFACTURING SAME

This is a 371 national phase application of PCT/JP2010/058280 filed 17 May 2010, the contents of which are incorporated herein by reference.

TECHNICAL FIELD

The present invention relates to a cylinder head with an EGR gas cooling structure which has a cooling passage for the EGR gas disposed in a water jacket and to a method for manufacturing the cylinder head.

BACKGROUND ART

Conventionally, an internal-combustion engine such as a gasoline engine includes an exhaust gas recirculation (EGR) device to reduce nitrogen oxides (NOx) generated in combustion processes and to improve fuel economy.

High combustion temperature in the combustion chamber causes oxidation of nitrogen in the air, thereby producing nitrogen oxides as toxic chemicals. The EGR device recirculates a part of the exhaust gas (EGR gas) as non-active gas (with low amount of oxygen) from the exhaust side to the intake side and mixes the exhaust gas with an intake air. Thus, the combustion temperature in the combustion chamber is lowered, and therefore the amount of nitrogen oxides is reduced.

As such EGR device, JP H6-76644 U discloses a technique that the gas passage guiding the EGR gas from the exhaust side to the intake side is disposed in the water jacket of the cylinder head in order to cool it effectively. In JP H6-76644 U, the gas passage may be formed by pipes (e.g., made of stainless) which are molded within the cylinder head.

SUMMARY OF INVENTION

Technical Problem

In the case that the EGR gas passage is arranged in the water jacket, inserting the thin hollow pipe into the cylinder head is preferable from the viewpoint of cooling performance for the EGR gas and productivity thereof. For instance, when the thin hollow pipe is molded within the cylinder head, the gas passage may be crashed under molding pressure (i.e., weight of molten metal and pressure due to contraction of the molten metal) acted on the outer surface of the pipe.

As mentioned above, it is difficult to manufacture the cylinder head having the EGR gas cooling structure with high cooling performance and being easily configurable.

The present invention provides a cylinder head having an EGR gas cooling structure and a method for manufacturing the same with high cooling performance and being easily configurable.

Technical Solutions

The present invention related to the cylinder head with the EGR gas cooling structure and the method for manufacturing the same includes following technical features.

The first embodiment of the invention is a cylinder head formed with an exhaust port, an intake port and a water jacket, which includes an EGR cooling structure including a gas passage guiding a part of exhaust gas from the exhaust port to the intake port, disposed in the water jacket for cooling the exhaust gas passing through the gas passage. The gas passage is configured by a pipe including: a cooling section being contact with a coolant in the water jacket; and high-strength sections disposed at both ends of the cooling section, having higher strength than the cooling section, and the high-strength sections are molded within the cylinder head.

The cooling section is free from the molding pressure and the deformation caused by the molding pressure rarely occurs on the cooling section, so that the cooling section can be configured as the flat pipe or thinner pipe than the high-strength section in order to achieve a high-cooling performance.

In the embodiment that the gas passage is arranged in the water jacket, EGR gas coolers disposed outside of the cylinder head are not necessary, thereby facilitating the structure of cooling the EGR gas. Moreover, the gas pipes for the EGR gas coolers are not necessary, whereby cooling the EGR gas is provided with saving space and with low cost.

Preferably, the cooling section is configured by a flat pipe.

The inner dimension along the short-side direction of the cooling section is small, thereby increasing the rate of the turbulent flow region in the EGR gas flow through the cooling section and increasing the surface area with respect to the section area in the cooling section. As the result, the heat exchanger effectiveness of the EGR gas is enhanced and the cooling performance is improved.

More preferably, the cooling section is configured by a pipe separated from the high-strength sections, and each of the high-strength sections includes a tubular side wall and a bottom closing one end of the side wall, the bottom having a slot into which the cooling section is inserted, and the ends of the cooling section are inserted into the slot, whereby the cooling section and the high-strength sections are connected.

Therefore, the gas passage can be easily configured and the productivity of manufacturing the cooling structure can be improved.

In the preferable embodiment, the tubular side wall has a circular section.

When the pressure accompanied by contraction of molten metal works on the outside of the high-strength section, the circular tubular side wall evenly receives the pressure, thereby prevented from deformation.

As the result, the high-strength sections are kept in contact with the cylinder head, so that the sealing performance of the water jacket can be secured.

Advantageously, the cooling section has a side face along the short-side direction, the cooling section is disposed such that the flow direction of the exhaust gas passing therethrough crosses the flow direction of the coolant passing through the water jacket and that the side face faces the flow direction of the coolant.

Such arrangement of the gas passage does not prevent the flow of the coolant in the water jacket and makes the coolant contact the outer surfaces of the cooling sections effectively, thereby improving the cooling performance for the EGR gas.

In the advantageous embodiment, the gas passage includes multiple cooling sections, which are aligned along the short-side direction.

The surface areas of cooling sections being contacted with the coolant in the water jacket can be enlarged with saving space, and the cooling performance can be enhanced.

More advantageously, the side wall has a groove or a projection formed along the circumferential direction thereof.

The part of the cylinder head that is inserted into the high-strength section is engaged with the groove or projection, thereby preventing the high-strength section from falling off the cylinder head and securing the sealing property between the cylinder head and the high-strength section.

Alternatively, the side wall has a slope in the inside thereof at the downstream side of the EGR gas flow, the inner diameter of the slope expanding from the upstream side to downstream side of the EGR gas flow.

As the result, condensed water generated in the cooling section is removed from the side wall and the gas passage is prevented from damage or degradation such as corrosion caused by the condensed water.

The second embodiment of the invention is a method for manufacturing a cylinder head formed with an exhaust port, an intake port and a water jacket, comprising: an EGR cooling structure including a gas passage guiding a part of exhaust gas from the exhaust port to the intake port, disposed in the water jacket for cooling the exhaust gas passing through the gas passage. The method includes configuring the gas passage by a pipe that includes: a cooling section being contact with a coolant in the water jacket; and high-strength sections disposed at both ends of the cooling section, having higher strength than the cooling section, and followed by inserting the high-strength sections into the cylinder head, whereby arranging the cooling section within the water jacket.

The cooling section is free from the molding pressure and the deformation caused by the molding pressure rarely occurs on the cooling section, so that the cooling section can be configured as the flat pipe or thinner pipe than the high-strength section in order to achieve a high-cooling performance.

In the embodiment that the gas passage is arranged in the water jacket, EGR gas coolers disposed outside of the cylinder head are not necessary, thereby facilitating the structure of cooling the EGR gas. Moreover, the gas pipes for the EGR gas coolers are not necessary, whereby cooling the EGR gas is provided with saving space and with low cost.

Preferably, the cooling section is configured by a flat pipe.

The inner dimension along the short-side direction of the cooling section is small, thereby increasing the rate of the turbulent flow region in the EGR gas flow through the cooling section and increasing the surface area with respect to the section area in the cooling section. As the result, the heat exchanger effectiveness of the EGR gas is enhanced and the cooling performance is improved.

In the preferable embodiment, he cooling section is configured by a pipe separated from the high-strength section, and each of the high-strength section includes a tubular side wall and a bottom closing one end of the side wall, the bottom having a slot into which the cooling section is inserted. The method further includes: connecting the ends of the cooling section inserted into the slot to the high-strength sections; forming a core surrounding the cooling section; holding the high-strength sections by a mold; and pouring molten metal into the mold for molding.

Such structure makes the production of the gas passage easier than the structure where the cooling sections and the high-strength sections are integratedly formed, so that the productivity of the cylinder head having the EGR gas cooling structure is improved.

The connecting step, the core forming step, the holding step and the molding step are performed in order, and in such case, the connection of the cooling sections with the high-strength sections is performed more easily than the case that they are connected after fitting the high-strength sections to the holder of the mold. Thus, the cylinder head with the EGR gas cooling structure can be produced with high productivity.

In the preferable embodiment, the tubular side wall has a circular section, and the high-strength section is molded within the cylinder head while holding the side wall by the mold.

As the result, the high-strength sections are kept in contact with the cylinder head, so that the sealing property of the water jacket can be secured.

Advantageously, the cooling section has a side face along the short-side direction, the cooling section is disposed such that the flow direction of the exhaust gas passing therethrough crosses the flow direction of the coolant passing through the water jacket and that the side face faces the flow direction of the coolant.

Such arrangement of the gas passage does not prevent the flow of the coolant in the water jacket and makes the coolant contact the outer surfaces of the cooling sections, thereby improving the cooling performance for the EGR gas.

In the advantageous embodiment, the gas passage includes multiple cooling sections, which are aligned along the short-side direction.

The surface areas of cooling sections being contacted with the coolant in the water jacket can be enlarged with saving space, and the cooling performance can be enhanced.

Advantageous Effects of Invention

Advantageous effects of the invention are described below.

According to the invention, the cooling section can be configured as the flat pipe or thinner pipe than the high-strength section in order to achieve a high-cooling performance. Furthermore, the EGR gas cooling structure can be easily configured, whereby cooling the EGR gas is provided with saving space and with low cost.

REFERENCE SIGNS LIST

Figure 1:
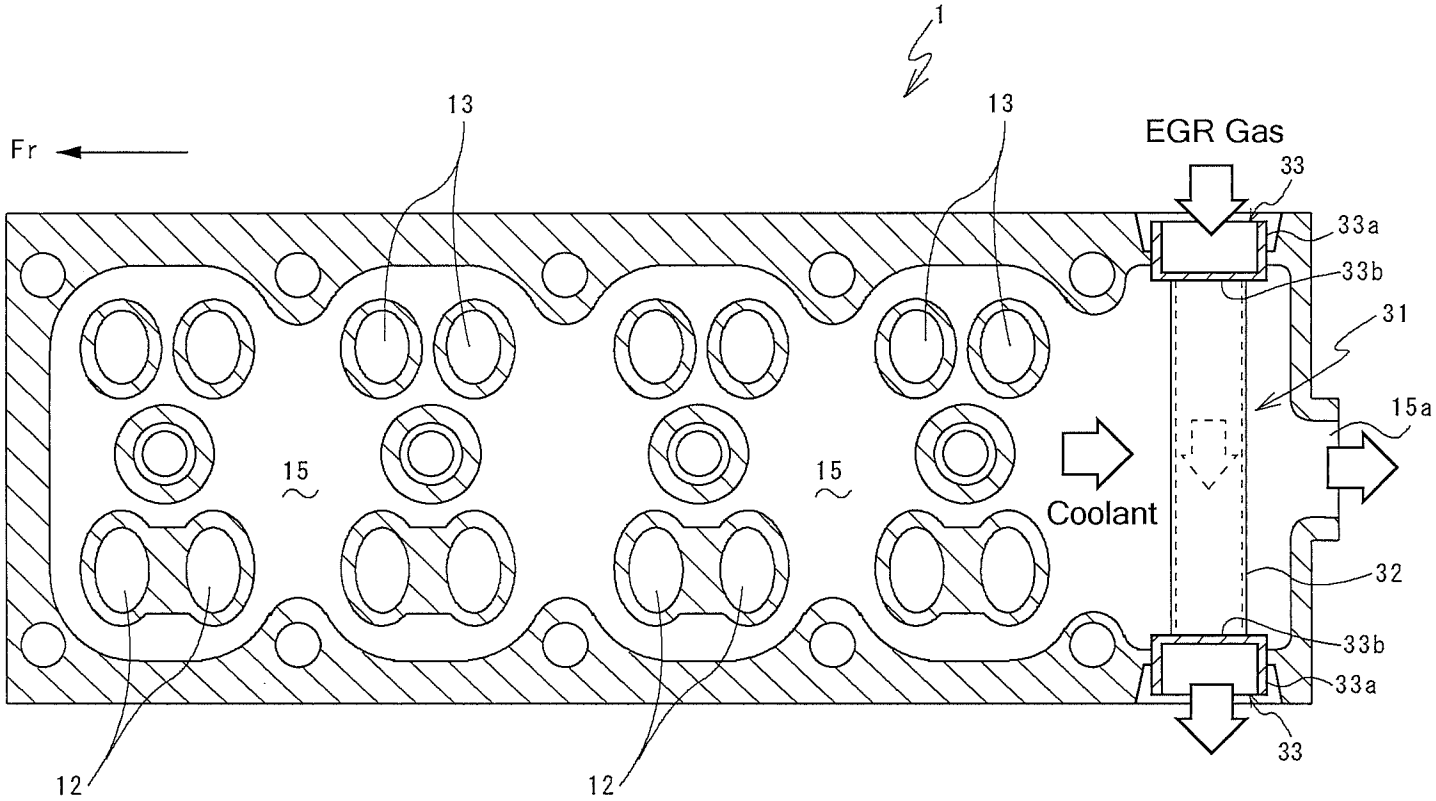
FIG. 1 is a plan sectional view of a cylinder head.
Figure 2:
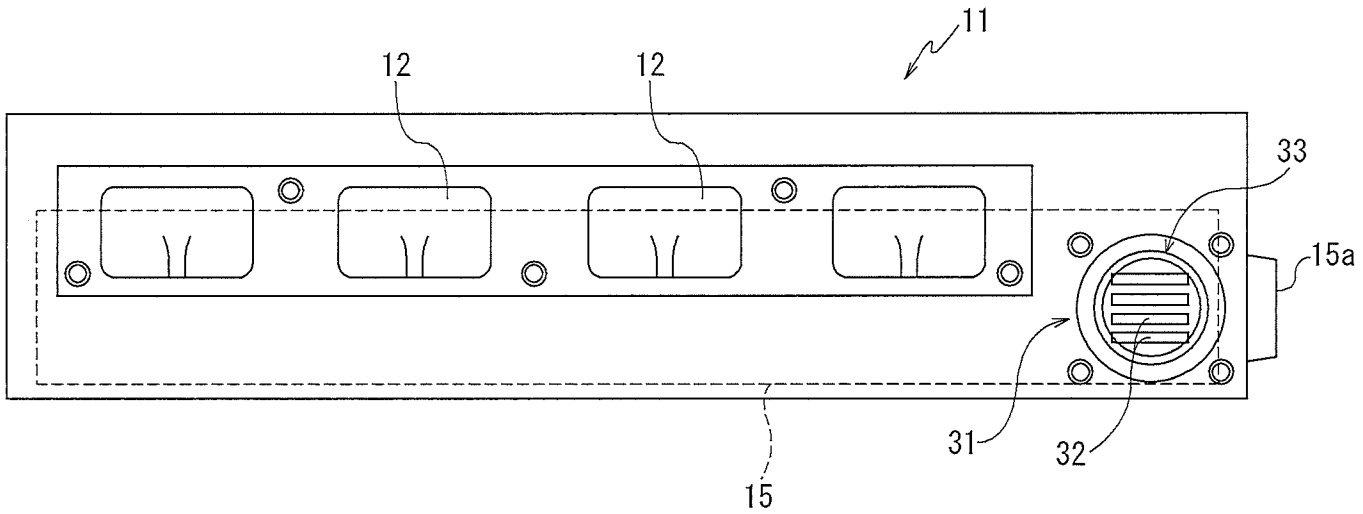
FIG. 2 depicts a side view of the cylinder head.

11: cylinder head
11*a*: pipe support
12: intake port
13: exhaust port
15: water jacket
31: EGR gas cooling pipe
32: cooling section
32*a*: wide face
32*b*: side face
33: high-strength section
33*a*: side wall
33*b*: bottom
33*c*: slot
33*d*: groove
33*e*: slope

DESCRIPTION OF EMBODIMENTS

Referring to attached drawings, the embodiment according to the present invention is described below.

FIGS. 1 to 5 depict a cylinder head 11 in accordance with the invention having a cooling structure for EGR gas. The cylinder head 11 is, for example, installed in an engine having multiple cylinders (in the embodiment, four cylinders) and has two intake ports 12 and two exhaust ports 13 corresponding to each of the cylinders.

The cylinder head 11 is formed with a water jacket 15 to cool the exhaust ports 13 and the like.

The water jacket 15 is formed from the front end (one end of the cylinder arrangement; left side in FIG. 1) of the cylinder head 11 to the rear end (the other end of the cylinder arrangement; right side in FIG. 1) thereof.

The water jacket 15 is filled with coolant and connected with a pump and a radiator (both not shown). Actuating the pump makes the coolant flow through the water jacket 15, thereby cooling the inside of the cylinder head 11.

In this embodiment, the coolant is flown into the water jacket 15 through the front side to the rear side of the cylinder head 11, and discharged via a coolant outlet 15*a* that is arranged at the rear end of the cylinder head 11.

The engine provided with the cylinder head 11 includes an EGR device for recirculating a part of the exhaust gas exhausted from the exhaust ports 13 (EGR gas) and mixing the EGR gas with an intake air.

The EGR device includes a gas passage for guiding the EGR gas to the intake ports 12. The gas passage includes an EGR gas cooling pipe 31 disposed in the cylinder head 11, through which the EGR gas is cooled by the coolant in the water jacket 15, a first connection pipe 22 (see FIG. 3) that is disposed between one end of the cooling pipe 31 (upper end in FIG. 3) and the exhaust pipe, guiding the EGR gas to the cooling pipe 31, and a second connection pipe 23 that is disposed between the other end of the cooling pipe 31 (lower end in FIG. 3) and the intake manifold communicated with the intake ports 12, guiding the EGR gas cooled in the cooling pipe 31 to the intake ports 12.

At the middle portion of the second connection pipe 23, there is an EGR valve to control the amount of the EGR gas recirculated to the intake ports 12.

In the EGR device, if the EGR valve is open when driving the engine, the EGR gas flows in the first connection pipe 22 and is guided into the cooling pipe 31. The EGR gas guided into the cooling pipe 31 is cooled in the cooling pipe 31 by the coolant in the water jacket 15. Therefore, the cooled EGR gas is recirculated to the intake manifold via the second connection pipe 23.

In the engine, the EGR device works in the above-described way, so that the EGR gas as non-active (low-oxygen) gas is mixed with the intake air in the intake manifold. As the result, the combustion temperature in the combustion chamber of the cylinder head is lowered, which reduces the nitrogen oxides.

The EGR gas cooling pipe 31 arranged in the water jacket 15 is described below.

The cooling pipe 31 is disposed between the coolant outlet 15*a* and the intake and exhaust ports 12, 13, which are arranged at the most downstream side of the coolant flow in the water jacket 15.

Figure 3:
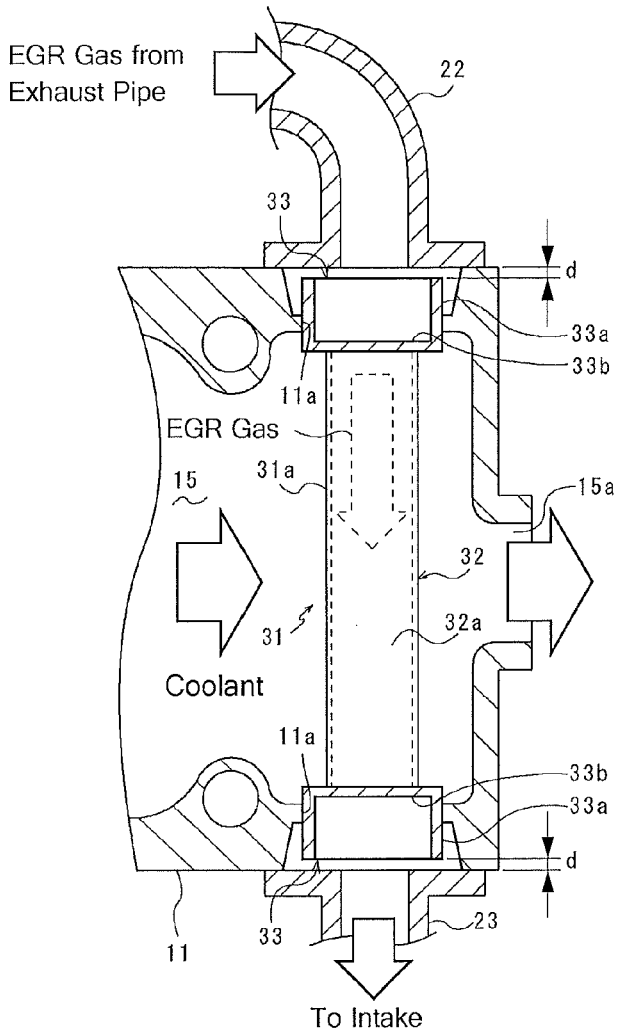
FIG. 3 is a plan sectional view of an EGR gas cooling structure of the cylinder head.
Figure 4:
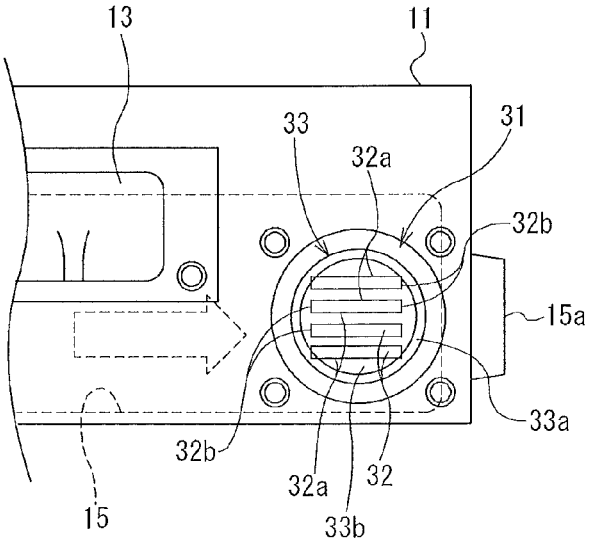
FIG. 4 depicts the side view of the EGR gas cooling structure.
Figure 5:
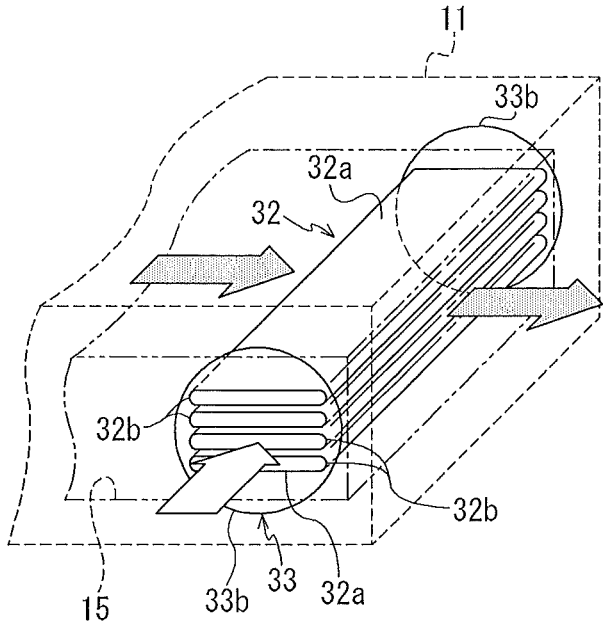
FIG. 5 is a perspective view of the EGR gas cooling structure.

As depicted in FIGS. 3 to 5, the cooling pipe 31 includes a cooling section 32 being contacted with the coolant in the water jacket 15 through which the EGR gas passes and two high-strength sections 33 that are arranged at both ends of the cooling section 32 and are molded within the cylinder head 11. The high-strength sections 33 are located at the both ends of the cooling section 32.

The cooling section 32 is configured in a thin hollow pipe having flat shape. In the EGR gas cooling pipe 31, the multiple cooling sections 32 are aligned in the short-side direction of the cooling section 32, spaced away from each other.

The cooling section 32 has a rectangular or oval shape having a short side along the alignment direction of them and a long side along the direction perpendicular to the alignment direction. The cooling section 32 has wide faces 32*a* and the multiple cooling sections are aligned to face the wide faces with each other.

The cooling section 32 is configured in the thin hollow pipe and the inner dimension along the short-side direction of the cooling section 32 is small, thereby increasing the rate of the turbulent flow region in the EGR gas flow through the cooling section 32 and increasing the surface area with respect to the section area in the cooling section 32. As the result, the heat exchanger effectiveness of the EGR gas is enhanced and the cooling performance is improved. Moreover, the cooling section 32 is constructed by the thin and hollow pipe, so that the cooling performance for the EGR gas can be improved.

In the cooling pipe 31, the multiple cooling sections 32 of flat hollow pipe are arranged in the short-side direction, and therefore the surface areas of cooling sections 32 being contacted with the coolant in the water jacket 15 can be enlarged with saving space. Thus, the cooling performance can be enhanced.

The cooling pipe 31 is arranged such that the flow direction of EGR gas in the cooling sections 32 crosses that of the coolant in the water jacket 15. In this embodiment, the flow direction of the EGR gas passing through the cooling sections 32 is perpendicular to the flow direction of the coolant passing through the water jacket 15.

In the cooling pipe 31, each of the side faces 32*b* along the short-side direction of the cooling pipes 32 faces the flow direction of the coolant passing through the water jacket 15. That is, the cooling sections 32 are arranged such that the wide faces 32*a* are parallel to the flow direction of the coolant in the water jacket 15.

Such arrangement of the EGR gas cooling pipe 31 does not prevent the flow of the coolant in the water jacket 15 and makes the coolant contact the outer surfaces of the cooling sections 32, thereby improving the cooling performance for the EGR gas.

Figure 6:
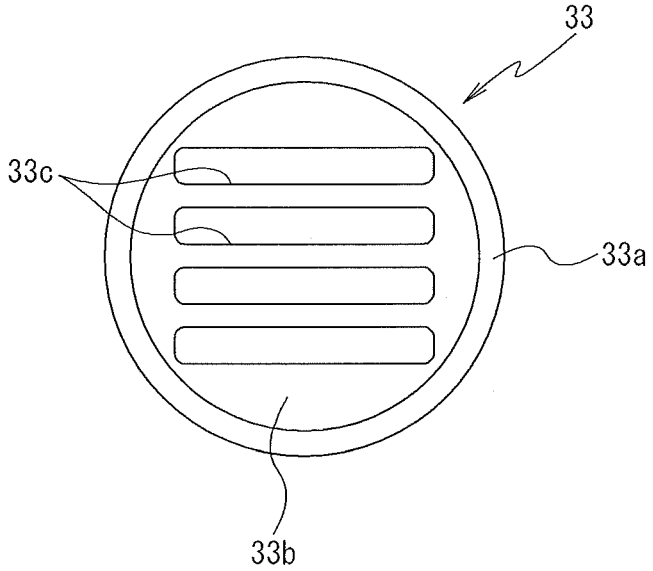
FIG. 6 depicts the side of a high-strength section of an EGR gas cooling pipe.
Figure 7:
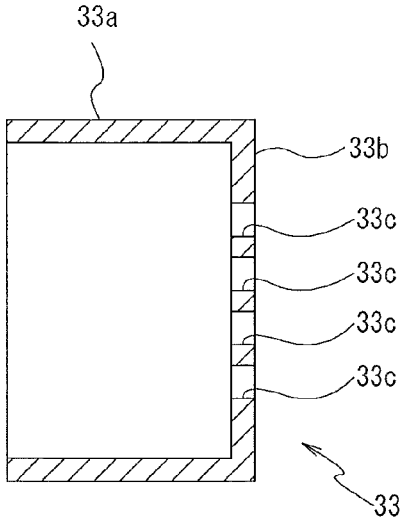
FIG. 7 is a front sectional view of the high-strength section.

As shown in FIGS. 6 and 7, each of the high-strength sections 33 has a side wall 33*a* formed in a circular tubular shape and a bottom 33*b* closing one end (in the axial direction) of the side wall 33*a*. The bottom 33*b* is formed with multiple slots 33*c* having shapes corresponding to the end of the cooling section 32, into which the end of the cooling section 32 can be inserted.

Figure 8:
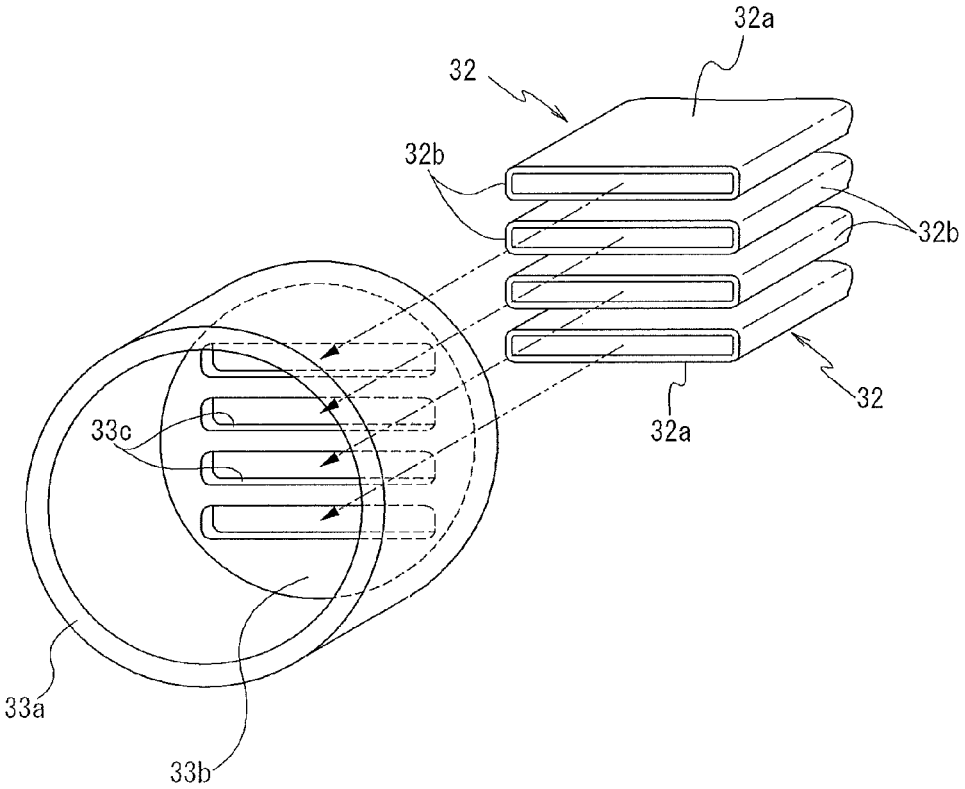
FIG. 8 is a perspective view illustrating the high-strength section and cooling sections connected to the high-strength section.

As shown in FIG. 8, the cooling sections 32 are inserted into the slots 33*c* of the bottom 33*b*, whereby each of the cooling sections 32 is connected to the high-strength section 33.

The bottom 33*b* and the cooling sections 32 are blazed and fixed to each other, in which the cooling sections 32 are inserted into the slots 33*c*.

In the high-strength section 33, the side wall 33*a* and the bottom 33*b* may be formed integratedly or fixed by blazing to each other.

The high-strength section 33 has higher strength than the cooling section 32. In particular, the high-strength section 33 has higher resistance against the contracting force acted on the outer surface than the cooling section 32. The higher strength can be provided by forming the side wall 33*a* of the high-strength section 33 in tubular shape with circular section, and in this respect, the cooling section 32 is formed in the flat shape.

Alternatively, the high-strength section 33 can be made of a material being thicker than that of the cooling section 32. The high-strength section 33 may be formed with a reinforcing portion such as a rib to provide the high strength.

The cooling section 32 and the high-strength section 33 may be made of aluminum or stainless steel.

As described above, the high-strength section 33 has the cylindrical tube shape with high strength and the cooling sections 32 are formed in the thin hollow pipes of flat shape having lower strength than the high-strength section 33. The cooling sections 32 and the high-strength section 33 have different characteristics from each other, and they are separated from each other. However, the EGR gas cooling pipe 31 is constructed in such a way that the cooling sections 32 are inserted into the slots 33*c* of the high-strength section 33. Therefore, the EGR gas cooling pipe 31 can be easily configured and the productivity of manufacturing the cooling structure can be improved.

The cylinder head 11 has two pipe supports 11*a* for supporting the high-strength sections 33 that are formed at the side walls parallel to the flow direction of the coolant passing through the water jacket 15.

The EGR gas cooling pipe 31 is attached to the cylinder head 11 via the pipe supports 11*a* holding the high-strength sections 33. In this embodiment, the high-strength sections 33 of the cooling pipe 31 are molded within the cylinder head 11 to be supported by the pipe supports 11*a*.

The cooling pipe 31 is fixed to the cylinder head 11 by inserting the high-strength sections 33 into the cylinder head 11. Thus, the cooling pipe 31 can be fixed without bolts, thereby reducing the number of parts constructing the cooling structure and manufacturing the cylinder head having the cooling structure with low cost.

When the high-strength sections 33 is molded within the cylinder head 11, the molding pressure (that is the weight of the molten metal and the pressure accompanied by contraction of the molten metal) acts on the high-strength sections 33, however the high-strength sections 33 have tubular side walls 33*a* to be reinforced against the pressure from the outside, so that the high-strength sections do not deform caused by the molding pressure.

In detail, when the pressure accompanied by the contraction of the molten metal works on the outside of the high-strength section 33, the circular tubular side wall 33*a* evenly receives the pressure, thereby prevented from deforming.

As the result, the high-strength sections 33 are kept in contact with the cylinder head 11, so that the sealing property of the water jacket 15 can be secured.

The cooling section 32 is disposed in the water jacket 15 where the pressure of molding the cylinder head 11 does not work, and therefore the cooling section can be configured with lower strength than the high-strength sections 33.

In the EGR gas cooling pipe 31, the high-strength sections 33 are molded within the cylinder head 11 to be held by the cylinder head 11, and the cooling section 32 for cooling the EGR gas is free from the molding pressure. So, the deformation caused by the molding pressure rarely occurs on the cooling section, and the cooling section 32 can be configured as the flat pipe or thinner pipe than the high-strength section 33 in order to achieve a high-cooling performance.

The flow of inserting the EGR gas cooling pipe 31 into the cylinder head 11 (molding the cooling pipe 31 within the cylinder head 11) is described below.

Figure 9:
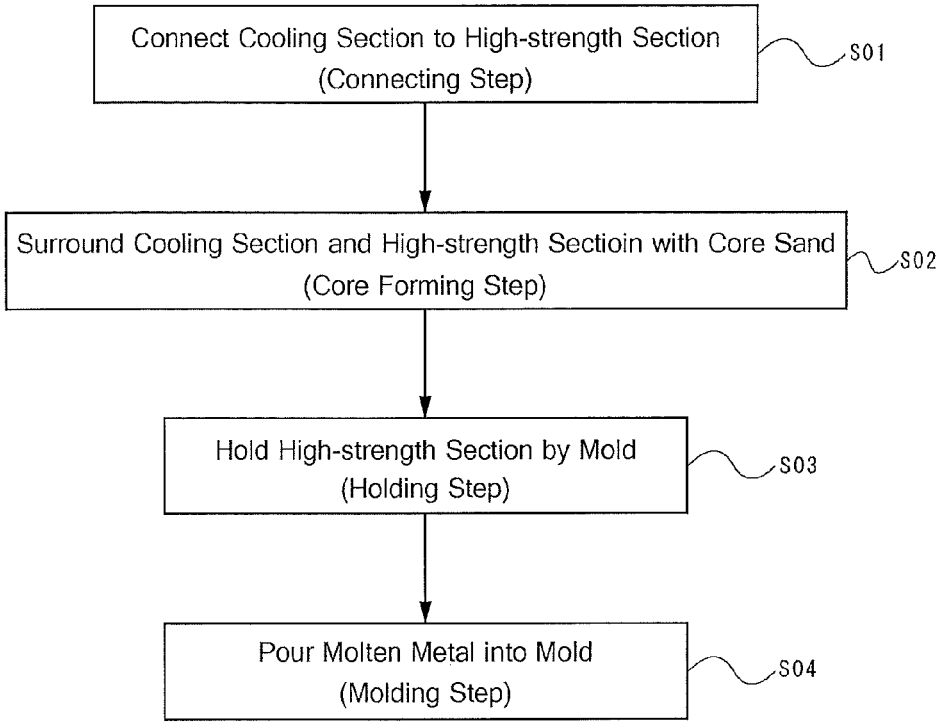
FIG. 9 is a flow of inserting the EGR gas cooling pipe into the cylinder head.

As shown in FIG. 9, before molding the cooling pipe 31, the ends of the cooling section 32 are inserted into the slots 33*c* formed in each of the bottom 33*b* of the high-strength section 33, and the cooling section 32 and the high-strength sections 33 are connected (Connecting step S01). The high-strength sections 33 are connected to the ends of the cooling section 32, thereby configuring the EGR gas cooling pipe 31.

After the connecting step, the cooling section 32 is surrounded by core sand to form the core (Core forming step S02).

The inner side of the high-strength section 33 (near the cooling section 32) may be surrounded by the core. It should be noted that the outer side of the high-strength section 33 is the portion inserted into the cylinder head 11 and held by a mold 1, so that the core is formed not to surround that portion.

The high-strength sections 33 are held with the mold for molding the cylinder head 11 (Holding step S03). The mold holds the high-strength sections 33, and the core formed in the core forming step is installed in the mold.

Figure 10:
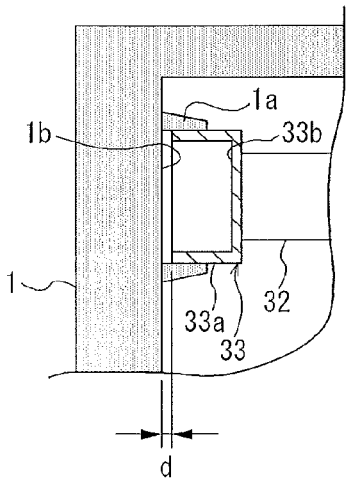
FIG. 10 is a plan sectional view of the portion of a mold where the high-strength section is molded within the cylinder head.

As shown in FIG. 10, the mold 1 is formed with ring holders 1*a* projecting inwardly. The outside of the high-strength section 33 is fitted into the inside of the holder 1*a*, and the mold 1 holds the high-strength section 33.

After the installation of the core in the mold, the molten metal is poured into the mold 1, thereby the cylinder head 11 is molded (Molding step S04). Thus, the high-strength sections 33 of the EGR as cooling pipe 31 are molded within the cylinder head 11.

When holding the high-strength section 33 by the holder 1*a* of the mold 1, there is a clearance by the predetermined distance d between the outer end of the high-strength section 33 and the inside 1*b* surrounded by the holder 1*a*. When holding the high-strength section 33 by the holder 1*a* of the mold 1, there is a sealing member between the holder 1*a* and the high-strength section 33 so that the molten metal poured into the mold 1 is not flown in the clearance of the predetermined distance d.

Due to such structures, the outer end of the high-strength section 33 is molded within the cylinder head 11 with spaced by the distance d from the outside of the cylinder head 11 (see FIG. 3).

The high-strength sections 33 arranged at both ends of the EGR gas cooling pipe 31 do not touch the connection pipes 22 and 23 connected to the cylinder head 11, and the high-strength sections 33 are free from load, thereby enhancing the sealing property between the cylinder head 11 and the high-strength sections 33.

The connecting step S01, the core forming step S02, the holding step S03 and the molding step S04 are performed in order, and the high-strength sections 33 of the EGR gas cooling pipe 31 are molded within the cylinder head 11.

The high-strength sections 33 are inserted in the cylinder head 11 and the EGR gas cooling pipe 31 is disposed in the water jacket 15, and therefore the cylinder head 11 is manufactured, in which the EGR gas cooling structure passes through the water jacket 15.

In the embodiment that the EGR gas cooling pipe 31 is arranged within the water jacket 15, EGR gas coolers disposed outside of the cylinder head 11 are not necessary, thereby facilitating the structure of cooling the EGR gas. Moreover, the gas pipes for the EGR gas coolers are not necessary, whereby cooling the EGR gas is provided with saving space and with low cost.

In the EGR gas cooling pipe 31 disposed in the water jacket 15 of the cylinder head 11, the cooling sections 32 and the high-strength sections 33 are configured as individual members. Such structure makes the production of the EGR gas cooling pipe 31 easier than the structure where the cooling sections 32 and the high-strength sections 33 are integratedly formed, so that the productivity of the cylinder head 11 having the EGR gas cooling structure is improved.

When inserting the high-strength sections 33 into the cylinder head 11, the cooling sections 32 and the high-strength sections 33 are connected before the high-strength sections 33 are fitted to the holder 1*a* of the mold 1, and the mold 1 holds the EGR gas cooling pipe 31. The connection of the cooling sections 32 with the high-strength sections 33 is performed more easily than the case that they are connected after fitting the high-strength sections 33 to the holder 1*a* of the mold 1. Thus, the cylinder head 11 with the EGR gas cooling structure can be produced with high productivity.

As descried before, the cooling sections 32 are configured by the flat pipes so that the cooling performance for the EGR gas passing through the cooling sections 32 is enhanced. The flatter the cooling sections are, the higher cooling performance is obtained.

Figure 11:
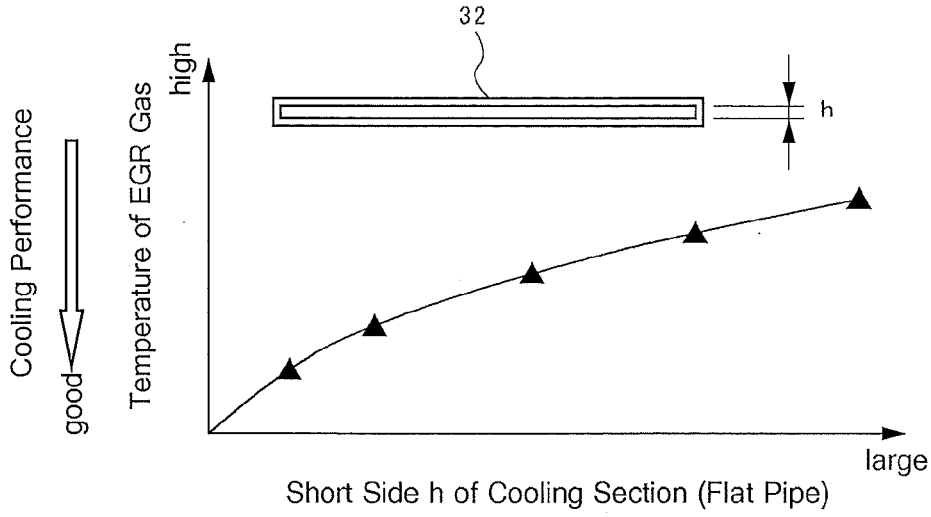
FIG. 11 shows a relationship between the dimension of the short side of the cooling section and the outlet temperature of the EGR gas.

FIG. 11 shows a relationship between the length of the short side (height) h in the section of the flat cooling section 32 and the temperature of the EGR gas at the outlet of the cooling section 32, that is, temperature of the EGR gas after cooling.

FIG. 11 indicates that as the height h becomes smaller, the temperature at the outlet becomes lower, namely that as the flatness of the cooling 32 becomes larger, the cooling performance becomes higher. The reason is that if the height h is small (i.e., if the cooling section 32 become thinner), the flow speed and heat conductivity of the EGR gas passing through the cooling section 32 is high.

Figure 12:
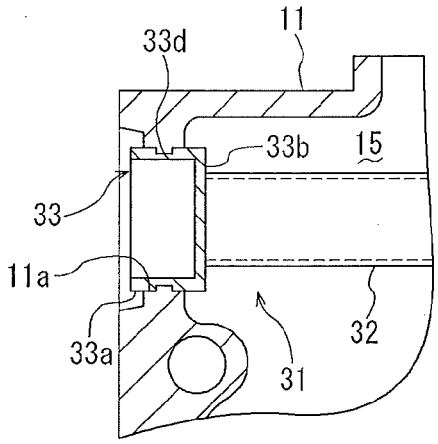
FIG. 12 depicts an advantageous embodiment of the high-strength section having a side wall formed with a groove at the outside thereof.

In the embodiment of FIG. 12, the side wall 33*a* of the high-strength section 33 has a groove 33*d* that is formed along the circumferential direction at the outside corresponding to the portion surrounded by the cylinder head 11 (at the portion supported by the supports 11*a*).

The side wall 33*a* has the groove 33*d* formed in the outside thereof, with which the part of the cylinder head 11 that is inserted into the high-strength section is engaged, thereby preventing the high-strength section 33 from falling off the cylinder head 11 and securing the sealing property between the cylinder head 11 and the high-strength section 33.

The side wall 33*a* may have a projection substituted for the groove, which achieves the same effects.

Figure 13:
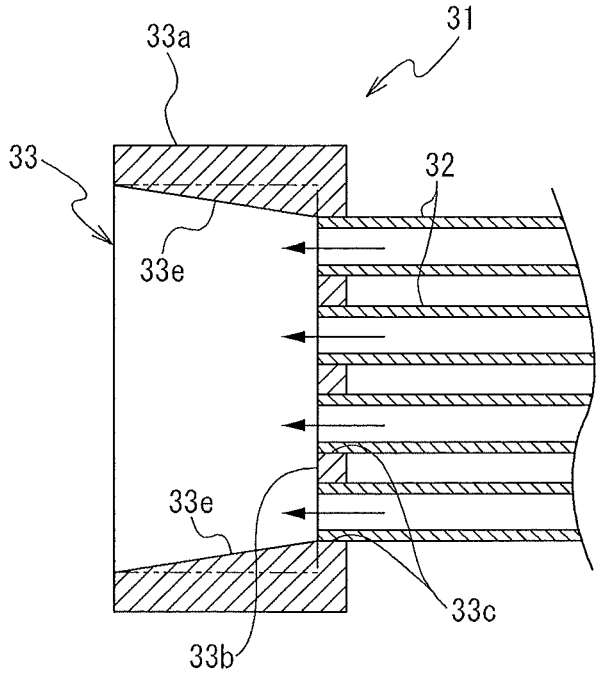
FIG. 13 depicts a preferable embodiment of the high-strength section having a slope formed in the inside at the outlet side of EGR gas.

In the embodiment of FIG. 13, the side wall 33*a* of the high-strength section 33 has a slope 33*e* that is formed in the inside thereof at the outlet side of the EGR gas cooling pipe 31 (at the downstream side of the EGR gas flow), and the inner diameter of the slope is expanded from the upstream side to downstream side of the flow direction of the EGR gas.

If the EGR gas is cooled in the cooling section 32, there occurs condensed water in the cooling section 32, which flows to the side wall 33*a* of the outlet side due to the EGR gas flow. The condensed water is guided by the slope 33*e* formed in the inside of the side wall 33*a*, whereby the condensed water is discharged to outside from the side wall 33*a*.

As the result, the condensed water is removed from the side wall 33*a* and the EGR gas cooling pipe 31 is prevented from degradation or damage such as corrosion caused by the condensed water.

INDUSTRIAL APPLICABILITY

The present invention is applicable to a cylinder head of an engine that includes an EGR device, in which the cylinder head has a cooling structure for the EGR gas.

The invention claimed is:

1. A cylinder head formed with an exhaust port, an intake port and a water jacket, comprising:

an exhaust gas recirculation (EGR) gas cooling structure including a gas passage guiding a part of exhaust gas from the exhaust port to the intake port, disposed in the water jacket for cooling the exhaust gas passing through the gas passage, wherein the gas passage is configured by a pipe comprising: a cooling section being in contact with a coolant in the water jacket, the cooling section configured in a thin hollow pipe; and high-strength sections disposed at both ends of the cooling section, having higher strength than the cooling section, wherein the cylinder head is molded around the high-strength sections, and the cooling section is arranged in the water jacket, wherein the cooling section is configured by a pipe separated from the high-strength sections, wherein each of the high-strength sections includes a tubular side wall and a bottom closing one end of the side wall, the bottom having a slot into which the cooling section is inserted, and the ends of the cooling section are inserted into the slot, whereby the cooling section and the high-strength sections are connected, wherein the cooling section is configured by a flat pipe, wherein the tubular side wall has a circular section, wherein the thickness of the flat pipe is thinner than that of the side wall, wherein the slot has a flat shape corresponding to the end of the cooling section, wherein a first connection pipe is connected to an outer surface the cylinder head at one end of the cooling section, wherein a second connection pipe is connected to the outer surface of the cylinder head at the other end of the cooling section, and wherein there is a space between an outer end of each of the high-strength sections and outer surfaces of the cylinder head.

2. The cylinder head according to claim 1, wherein the cooling section has a side face along the short-side direction, the cooling section is disposed such that the flow direction of the exhaust gas passing therethrough crosses the flow direction of the coolant passing through the water jacket and that the side face faces the flow direction of the coolant.

3. The cylinder head according to claim 1, wherein the gas passage includes multiple cooling sections, which are aligned along the short-side direction.

4. The cylinder head according claim 1, wherein the side wall has a groove or a projection formed along the circumferential direction thereof.

5. The cylinder head according to claim 1, wherein the side wall has a slope in the inside thereof at the downstream side of the (EGR) gas flow, the inner diameter of the slope expanding from the upstream side to downstream side of the (EGR) gas flow.

6. A method for manufacturing a cylinder head formed with an exhaust port, an intake port and a water jacket, comprising: an exhaust gas recirculation (EGR) gas cooling structure including a gas passage guiding a part of exhaust gas from the exhaust port to the intake port, disposed in the water jacket for cooling the exhaust gas passing through the gas passage, the method comprising:

configuring the gas passage by a pipe comprising: a cooling section being contact with a coolant in the water jacket, the cooling section configured in a thin hollow pipe; and high-strength sections disposed at both ends of the cooling section, having higher strength than the cooling section, molding the cylinder head around the high-strength sections, whereby arranging the cooling section within the water jacket, wherein the cooling section is configured by a pipe separated from the high-strength section, and each of the high-strength section includes a tubular side wall and a bottom closing one end of the side wall, the bottom having a slot into which the cooling section is inserted, connecting the ends of the cooling section inserted into the slot to the high-strength sections, wherein the cooling section is configured by a flat pipe, wherein the tubular side wall has a circular section, wherein the thickness of the flat pipe is thinner than that of the side wall, and wherein the slot has a flat shape corresponding to the end of the cooling section, wherein a first connection pipe is connected to an outer surface the cylinder head at one end of the cooling section, wherein a second connection pipe is connected to the outer surface of the cylinder head at the other end of the cooling section, and wherein there is a space between an outer end of each of the high-strength sections and outer surfaces of the cylinder head.

7. The method according to claim 6, the method comprising:

forming a core surrounding the cooling section;

holding the high-strength sections by a mold; and pouring molten metal into the mold for molding.

8. The method according to claim 7, wherein the connecting, forming, holding and pouring are performed in order.

9. The method according to claim 7, wherein the side wall has a circular section, and wherein the high-strength section is molded within the cylinder head while holding the side wall by the mold.

10. The method according to claim 6, wherein the cooling section has a side face along the short-side direction, the cooling section is disposed such that the flow direction of the exhaust gas passing therethrough crosses the flow direction of the coolant passing through the water jacket and that the side face faces the flow direction of the coolant.

11. The method according to claim 6, wherein the gas passage includes multiple cooling sections, which are aligned along the short-side direction.

12. The method according to claim 6, the method comprising:

connecting the ends of the cooling section inserted into the slot to the high-strength sections;

forming a core surrounding the cooling section;

holding the high-strength sections by a mold; and pouring molten metal into the mold for molding.

13. The method according to claim 12, wherein the connecting, forming, holding and pouring are performed in order.

14. The method according to claim 12, wherein the side wall has a circular section, and wherein the high-strength section is molded within the cylinder head while holding the side wall by the mold.

* * * * *